United States Patent [19]

Weimar et al.

[11] 3,936,035

[45] Feb. 3, 1976

[54] SOUND DAMPING CURTAIN WALL

[76] Inventors: Ake John Hugo Conrad Weimar, Larsbergsvagen 51, S-181 38 Lindigo; Hans Hjalmar Gustafson, Tradgardsgatan 22, S-172 38 Sundbyberg, both of Sweden

[22] Filed: Apr. 3, 1974

[21] Appl. No.: 457,607

[30] Foreign Application Priority Data

Apr. 6, 1973 Sweden ..... 04851/73

[52] U.S. Cl. ..... 256/13.1; 181/33 HE

[51] Int. Cl.[2] ..... F01N 1/10; E01F 15/00

[58] Field of Search ..... 256/13.1, 21, 22, 24, 25, 256/26, 59, 65; 52/300, 144; 181/33 G, 33 GB, 33 HE, 33 R, 30

[56] References Cited

UNITED STATES PATENTS

| | | | |
|---|---|---|---|
| 1,785,067 | 12/1930 | Bemis | 52/300 X |
| 1,825,465 | 9/1931 | MacDonald | 181/33 GB |
| 2,327,311 | 8/1943 | Lundy | 256/21 UX |
| 3,049,190 | 8/1962 | Coffman | 181/33 GB |
| 3,411,605 | 11/1968 | Coffman et al. | 181/33 GB |
| 3,667,175 | 6/1972 | Bjorksten | 181/33 G X |
| 3,672,463 | 6/1972 | Jaffe et al. | 181/30 |
| 3,812,931 | 5/1974 | Havskins | 181/33 R X |

FOREIGN PATENTS OR APPLICATIONS

| | | | |
|---|---|---|---|
| 228,822 | 8/1963 | Austria | 256/13.1 |
| 1,384,882 | 11/1964 | France | 52/300 |
| 663,513 | 8/1938 | Germany | |
| 262,988 | 11/1949 | Switzerland | |

*Primary Examiner*—Dennis L. Taylor

*Attorney, Agent, or Firm*—Burns, Doane, Swecker & Mathis

[57] ABSTRACT

A sound damping curtain wall is disclosed having a plurality of generally parallel tubular damping elements arranged in side by side fashion. Each damping element is fabricated from thin flexible material and may include longitudinally extending corrugations. Each end of each damping element is provided with a recess having a cross-section that conforms to the cross-section of generally horizontally extending beams which are received therein. The beams are attached to generally vertical posts set in a suitable foundation. Each vertical post may be arranged inside a corresponding damping element. With the damping elements disposed between the generally horizontal beams and the vertical posts, each damping element is resiliently pressed against each adjacent damping element.

4 Claims, 4 Drawing Figures

SOUND DAMPING CURTAIN WALL

The present invention relates to a sound damping curtain wall comprising a plurality of tubular parallel damping elements arranged side by side.

Such curtain walls are known for very special applications in acoustical damping for buildings, and are extremely heavy and unmanageable.

There is therefore a need for a more universally usable curtain wall, which is specially suited to placing along roads carrying heavy traffic going through densely built-up areas, but is also usable in other connections, e.g., large localities, and which can not only be arranged in a vertical position, but also in a sloping or even a horizontal position to obtain the best effect in different applications.

Such a curtain wall, has according to the invention, been obtained by the damping elements being formed with flexible walls and that the elements are joined together, preferably resiliently pressed against each other, by the use of attaching means extending along both the end portions of the elements, to which the end portions of the elements are connected. In principle, a curtain wall of this kind has double walls, between which a large volume of air is enclosed, which as is known creates good sound insulating properties. The curtain wall is furthermore easy to manufacture. Since the tubular damping elements have flexible walls, the appearance of cracks passing sound through thus being prevented in a simple manner.

The greatest and most important field of use for the curtain wall according to the invention is within traffic planning to protect housing areas from traffic noise from roads having heavy traffic. For this purpose the curtain wall according to the invention is suitably made so that the attaching means each comprises a beam arranged in recesses corresponding to the cross section of the beam, at the ends of the elements, said beams being rigidly connected to vertical posts set in a foundation. According to a preferred embodiment of the invention the tubular walls of the damping elements are longitudinally corrugated, so that the walls of the elements abutting each other will be in engagement with each other, whereby the damping elements are effectively prevented from movement between themselves. An especially attractive embodiment consists of the posts each being arranged inside a tubular damping element.

Figure 1:
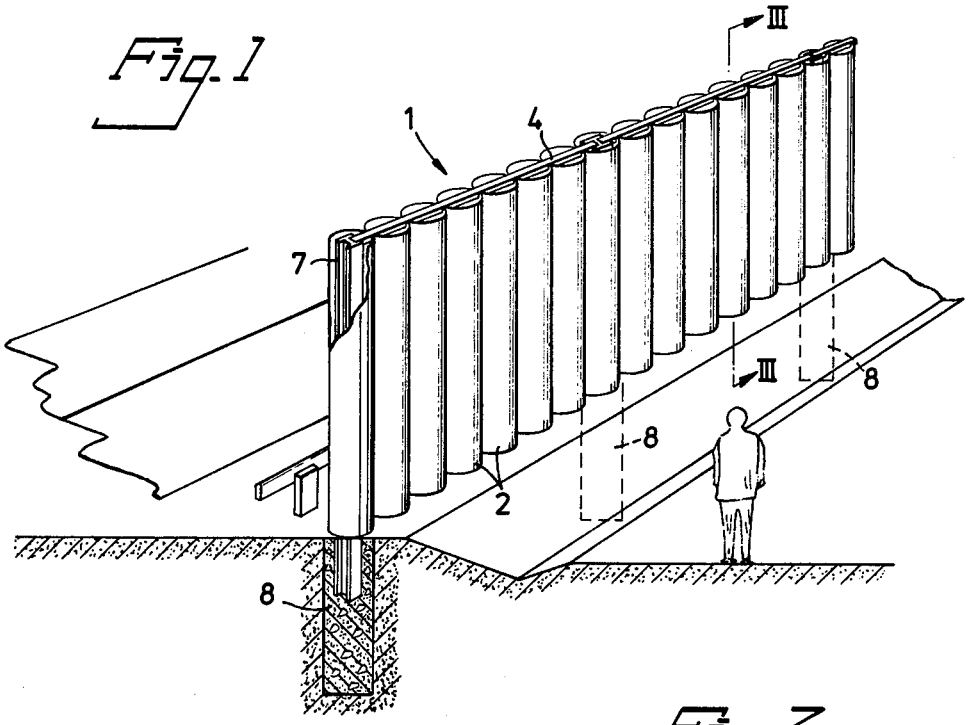
Figure 2:
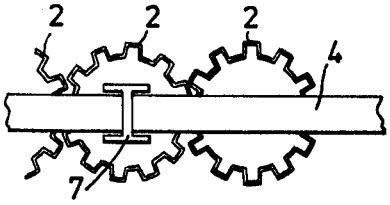
Figure 3:
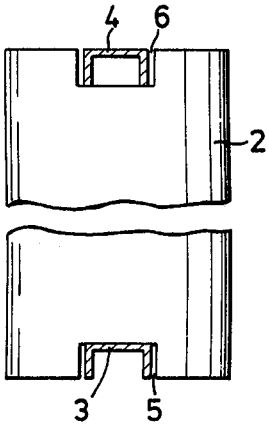
Figure 4:
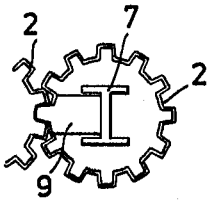

The invention will now be described more closely in the following while referring to the attached drawing, on which FIG. 1 diagrammatically and in perspective shows a curtain wall according to one embodiment of the invention set up along a road, FIG. 2 is a plan view of a part of the curtain wall shown in FIG. 1, FIG. 3 is a section along line III—III in FIG. 1 and, FIG. 4 is a plan view of the terminating damping element in a curtain wall.

The curtain wall 1 shown on the drawing consists of a number of plastic coated steel sheet tubes 2, fastened between a lower beam 3 and an upper beam 4 which are fitted into recesses 5, 6 in the lower and upper ends respectively of tube 2. The beams 3 and 4 are attached by welding or by screws (not shown) into posts 7 which are cast into foundations 8 in the ground at equidistant intervals. The posts 7 are each situated within a tube 2 and are thus not visible from the outside.

Tubes 2 can for example be cylindrical as is shown for the sake of simplicity in FIG. 1, but are preferably longitudinally corrugated so that they thus have the cross section shown in FIG. 2 for example. As stated above, tubes 2 are resiliently attached between the outmost situated tubes of the curtain wall. To take up the compressive forces on the outmost situated tubes 2, these are, as is shown in FIG. 4, suitably provided with suitably fitted distance pieces 9, which are welded onto or otherwise attached between post 7 and tube 2, for providing the necessary compressive force. Such distance pieces can also be put in at intermediate posts where required.

The invention is naturally not limited to the embodiment shown on the drawing and described above, but can be modified in many ways within the scope of the invention defined by the claims. An exterior post construction can thus be alternatively used, as well as a cross section for the tubes 2 other than the one shown on the drawing. Instead of plastic coated steel sheet for tubes 2, plastic tubes or tubes from surface finished aluminium can be used for example.

We claim:

1. A sound damping curtain wall comprising a plurality of separate substantially empty tubular parallel damping elements arranged side by side being operable to acoustically damp sound, each damping element having flexible walls and two end portions with recesses, means for resiliently pressing the damping elements laterally against each other including a pair of spaced-apart generally vertical posts, connecting means extending along and operably received by the recesses of the damping elements and attached to the generally vertical posts.

2. A curtain wall according to claim 1, wherein the connecting means includes a beam, wherein the recesses correspond to the cross section of the beams and are located in the ends of the damping element, and wherein the beams are fixedly attached to vertical posts set in a foundation.

3. A curtain wall according to claim 1, wherein the walls of the tubular damping elements are longitudinally corrugated and the corrugations of the walls in adjacent elements are in engagement with each other.

4. A curtain wall according to claim 3, wherein the posts are each arranged inside its tubular damping element.

* * * * *